US005686229A

United States Patent [19]

Twist

[11] Patent Number: 5,686,229

[45] Date of Patent: Nov. 11, 1997

[54] METHOD OF PROCESSING A COLOR PHOTOGRAPHIC SILVER HALIDE MATERIAL

[75] Inventor: Peter J. Twist, Gt. Missenden, United Kingdom

[73] Assignee: Eastman Kodak Company, Rochester, N.Y.

[21] Appl. No.: 713,304

[22] Filed: Sep. 13, 1996

[30] Foreign Application Priority Data

Sep. 15, 1995 [GB] United Kingdom ..... 9518912

[51] Int. Cl.[6] ..... G03C 7/407

[52] U.S. Cl. ..... 430/373; 430/414; 430/418; 430/419; 430/943

[58] Field of Search ..... 430/373, 414, 430/418, 419, 943

[56] References Cited

U.S. PATENT DOCUMENTS

| | | | |
|---|---|---|---|
| 3,817,751 | 6/1974 | Matejec | 430/943 |
| 4,045,225 | 8/1977 | Shimamura et al. | 430/373 |
| 4,062,684 | 12/1977 | Hara et al. | 430/373 |
| 4,069,050 | 1/1978 | Hara et al. | 430/943 |
| 4,880,725 | 11/1989 | Hirai et al. | 430/469 |
| 5,387,499 | 2/1995 | Earle et al. | 430/414 |
| 5,445,925 | 8/1995 | Marsden et al. | 430/414 |

FOREIGN PATENT DOCUMENTS 0 718 686 A1 6/1996 European Pat. Off. .

*Primary Examiner*—Hoa Van Le
*Attorney, Agent, or Firm*—J. Lanny Tucker

[57] ABSTRACT

A photographic material is processed by fixing during or after development, followed by redox amplification while monitoring image formation and adjusting to treatment time or composition of the redox amplifying solution, to obtain desired results.

12 Claims, No Drawings

METHOD OF PROCESSING A COLOR PHOTOGRAPHIC SILVER HALIDE MATERIAL

FIELD OF THE INVENTION

This invention relates to a method of processing a color photographic silver halide material and, in particular, a process in which dye image is formed by a redox amplification process.

BACKGROUND OF THE INVENTION

Redox amplification processes have been described, for example in British Specification No. 1,268,126, U.S. Pat. No. 3,748,138, U.S. Pat. No. 3,822,129 and U.S. Pat. No. 4,097,278. In such processes color materials are developed to produce a silver image (which may contain only small amounts of silver) and then treated with a redox amplifying solution (or a combined developer-amplifier) to form a dye image.

The developer-amplifier solution contains a color developing agent and an oxidizing agent which will oxidize the color developing agent in the presence of the silver image which acts as a catalyst.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

Oxidized color developer reacts with a color coupler to form the image dye. The amount of dye formed depends on the time of treatment or the availability of color coupler and is less dependent on the amount of silver in the image as is the case in conventional color development processes.

It is therefore possible to obtain quite different results according to how long the material is treated with the redox amplification solution and whether there have been variations in the contents of the amplifier solution. Thus unwanted variations can occur in the final image.

German specification DE-A-2 646 807 describes a method of processing a color material comprising a black-and-white development, a fix with bromide ions, wash, dry, color develop and amplify. Excellent amplification is reported with minimum fogging. Since bromide ions are known to inhibit amplification severely it is assumed that the wash step removes them from the material. There is no mention of monitoring the production of the dye image with visible light or taking any action dependent thereupon.

Comparative Examples 2 and 3 below show that both ammonium bromide and thiosulfate inhibit redox amplification.

The problem therefore is to provide a processing method in which more control on the quality of the final image can be achieved as the image itself is being formed.

SUMMARY OF THE INVENTION

According to the present invention there is provided a method of processing an imagewise exposed photographic silver halide color material comprising two or more silver halide layers sensitized to different regions of the visible spectrum having associated therewith appropriate dye image forming couplers, the method comprising during or after a development step that produces a silver image, fixing the material using a fixing solution comprising a fixing agent that does not poison the catalytic properties of the silver image to an extent that is more severe than a 30 g/l solution of sodium sulfite, and subsequently forming a dye image by redox amplification while monitoring the extent of image formation with visible light and making adjustments to the time of treatment or composition of the redox amplifying solution in order to obtain results of a predetermined quality.

Since dye density can be monitored in "real-time" a decision as to the final acceptability of the image can be made. If at some partially complete time the image is of higher or lower density than expected in the normal amplification time then that time can be shortened or lengthened as appropriate. This method would allow correct dye images to be formed even though the processing solution composition was varying due, for example, to solution instability or incorrect replenishment.

The composition of the redox amplification processing solutions can vary in a continuous processing machine. The results of monitoring the dye image while it is being formed could therefore be used to adjust replenishment rates or the temperature to maintain the sensitometric results on aim.

The invention is particularly suitable for use with Low Volume Thin Tanks (LVTTs) which have much smaller volume than conventional tanks and thus allow chemical or temperature changes to be quickly made.

DETAILED DESCRIPTION OF THE INVENTION

The dye image formation may be monitored by means of visible light, for example, in room light or daylight, as the light-sensitive silver halide has been removed in the fixer. The monitoring may be by a sensor built in to a processing machine that could be programmed to stop the redox amplification step when a predetermined set of conditions are observed. Such conditions could comprise a particular overall density or density of a particular color, etc. The data obtained from the sensor may be compared with data obtained from the printer that imagewise exposed the material before any changes are made. Such a comparison would more easily enable the machine to determine whether the processing solution needed adjustment or whether the individual frame was significantly non-average.

Alternatively the process may be carried out by hand and the photographic material removed from the developer/amplifier when judged suitable by the eye of the operator. It is a very flexible method of processing and highly suitable for hand made color prints of high quality.

If the state of the dye image is not on aim at some intermediate time in the amplification stage then the amplification solution could be replenished or otherwise changed chemically so that by the end of the amplification stage the correct result was obtained.

The initial development to form the silver image is preferably carried out in either a color or black-and-white developer solution. The color developing agent may be one of the following:

4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride, 4-amino-N-ethyl-N-(2-methoxy-ethyl)-m-toluidine di-p-toluene sulfonate, and, especially, 4-N-ethyl-N-(β-methanesulfonamidoethyl)-o-toluidine sesquisulfate (CD3).

The black-and-white developing agent may be a hydroquinone, a p-aminophenol or a pyrazolidinone or, more usually, a combination of one of the last two with hydroquinone.

The fixing agent used in the fixing solution must not poison the catalytic properties of the silver image. Thiosulfates or thiocyanates are therefore not suitable. Such compounds include polycarboxylic or polyphosphonic amino acids. The preferred fixing agents include compounds having at least one:

$$N—[(CH_2)_n—A]_p$$

moiety wherein A is —COOH or —$PO_3H_2$ and n is 1–6 and p is 1–3 provided that the compound contains at least 2 A groups.

Examples of such compounds include:

ethylenediaminetetraacetic acid (EDTA), propylenediaminetetraacetic acid, 2-hydroxy-1,3-propylenediaminetetraacetic acid, diethylenetriaminepentaacetic acid, nitrilotriacetic acid, ethylenediaminetetramethylene phosphonic acid, diethylenetriaminepentamethylene phosphonic acid, cyclohexylenediaminetetraacetic acid,

[(ethylenedioxy)diethylenedinitrilo]tetraacetic acid, and ethylene dinitrilo-N,N'-bis(2-hydroxybenzyl)-N,N'-diacetic acid The fixing solution may also contain a fix accelerator. Such fixing accelerators may, for example, be an alkanolamine or a dithioalkane diol.

The fixing accelerator should not inhibit redox image amplification. They may be chosen from among known fix accelerators by testing them to see if they inhibit the redox image amplification or react with hydrogen peroxide.

Examples of suitable fixing accelerators are:

primary, secondary, tertiary alkylamines, for example, ethylamine, propylamine, diethylamine, triethylamine or cyclohexylamine, alkyl diamines, for example, ethylene diamine, propylene diamine or cyclohexyl diamine, alkyl triamines, tetramines, pentamines, hexamines, for example, diethylene triamine, triethylene tetramine, cyclic polyamines, for example, hexamethylene tetramine, aryl amines, for example, benzyl amine, mono, di, tri-alkanolamines, for example, ethanolamine, propanolamine, diethanolamine, or dipropanolamine, thioethers, for example, dithiaoctane diol, thioamines, and morpholine.

Preferred fixing solutions comprise an alkali metal sulfite at 1–200 g/l, preferably 10–60 g/l, (as sodium sulfite) or a polycarboxylic amino acid at 5–150 g/l, preferably from 10–100, especially 40–60 g/l.

The effectiveness of fix accelerator varies considerably but typically they may be present in amounts in the range from 0.01 to 150 g/l preferably from 0.1 to 80 g/l. Diethanolamine, for example, may be used at 20–80 g/l.

The latter combination may be incorporated in the developer thus performing the development and fixing in a single solution.

The redox amplification step may be carried out in an amplifier solution comprising an oxidant, e.g., hydrogen peroxide or a compound that yields hydrogen peroxide. Such a process would require that sufficient color developing agent was absorbed by the material in a first color developer solution. Separate color developing and amplification or, preferably, a combined developer/amplifier is used which contains a color developing agent, e.g., any of those listed above, in addition to the oxidant. The amplifier or developer/amplifier solution may contain from 0.1 to 100 ml/l of hydrogen peroxide 30% w/w solution per liter and from 0.5 to 12 g/l of color developing agent, preferably from 3 to 7 g/l.

The pH of the developer/amplifier may be above 10, for example, in the range 11 to 12.5. Preferably the pH is in the range 11.3 to 11.7. It may be buffered with a phosphate.

The phosphate used may be a sodium or potassium phosphate. It may be present in the color developer in amounts of 20 to 80 g/l, preferably 25 to 60 g/l, particularly 35 to 45 g/l (as potassium phosphate).

The color developer solution may also contain compounds that increase its stability, for example hydroxylamine, diethylhydroxylamine and/or a long chain compound that can adsorb to silver, e.g., dodecylamine. Such long chain compounds can also be present in the amplifier solution.

The fix step may be followed by a wash step. This is necessary when the fixing solution comprises a sulfite but can be omitted if the fixer is the diethylenetriaminepentaacetic acid/ethanolamine combination mentioned above.

A particular application of this technology is in the processing of silver chloride color paper, for example, paper comprising an emulsion having at least 85 mole percent silver chloride, especially such paper with low silver levels, for example, total silver levels below 130 mg/m$^2$, e.g., from 25 to 120 mg/m$^2$, preferably below 70 mg/m$^2$ and particularly in the range 20 to 70 mg/m$^2$. Within these total ranges the blue sensitive emulsion layer unit may comprise 20 to 60 mg/m$^2$, preferably 25 to 50 mg/m$^2$ with the remaining silver divided between the red and green-sensitive layer units, preferably more or less equally between the red and green-sensitive layer units.

The present method can also be applied to silver halide materials containing more conventional levels of silver. In such a case the first developer should be a black-and-white developer.

As long as the silver level is low enough, a bleach step may be dispensed with as the contribution to the density of the image by the silver will be negligible.

The photographic materials can be two color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in the emulsions and elements processed by the method of this invention, are described in *Research Disclosure* Item 36544, September 1994, published by Kenneth Mason Publications, Emsworth, Hants, United Kingdom.

The present processing method is preferably carried out by passing the material to be processed through a tank containing the processing solution which is recirculated through the tank at a rate of from 0.1 to 10 tank volumes per minute. Such a tank is often called a low volume thin tank or LVTT for short.

The preferred recirculation rate is from 0.5 to 8, especially from 1 to 5 and particularly from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length×width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. No. 5,294,956, U.S. Pat. No. 5,179,404, U.S. Pat. No. 5,270,762, EP 559,025, EP 559,026, EP 559,027, WO 92/10790, WO 92/17819, WO 93/04404, WO 92/17370, WO 91/19226, WO 91/12567, WO 92/07302, WO 93/00612, WO 92/07301, WO 92/09932, and U.S. Pat. No. 5,436,118.

The following Examples illustrate the invention and are included for a better understanding of the invention.

EXAMPLE 1

A color developer solution of the following composition was made up.

TABLE 1

| Color Developer Composition | |
|---|---|
| AC5 | 0.6 g/l |
| DTPA | 0.81 g/l |
| $K_2HPO_4.3H_2O$ | 40 g/l |
| KBr | 1 mg/l |
| KCl | 0.5 g/l |
| HAS | 1.0 g/l |
| CD3 | 4.5 g/l |
| TWEEN 80 | 0.8 g/l |
| Dodecylamine (10%) | 1.0 ml/l |
| pH | 11.4 |

Where AC5 is a 60% solution of 1-hydroxyethylidene-1, 1-diphosphonic acid, DTPA is diethylenetriaminepentaacetic acid, HAS is hydroxylaminesulfate, CD3 is N-[2-(4-amino-N-ethyl-m-toluidino)ethyl]methanesulfonamide sesquisulfate hydrate, TWEEN 80 is a polyoxyethylene nonionic surfactant from Altas Chemicals and dodecylamine (10%) is a 10% solution of dodecylamine in an equimolar amount of acetic acid.

A redox amplifier was made by adding 2.0 ml/l of hydrogen peroxide(30% w/w) to the above solution.

The fixing solution was an aqueous sodium sulfite (30 g/l) solution.

Strips of a photographic silver chloride color paper having a total silver coverage of 62 $mg/m^2$ were imagewise exposed and processed in the following cycle;

| | |
|---|---|
| color develop | 30 sec (dark) |
| fix | 1 min (dark) |
| wash | 2 min (light) |
| amplify | variable (light) |
| wash | 2 min |
| dry | |

The last strip was exposed and processed in the amplifier for 45 seconds without the preceding develop and fix stages.

The densities of the final image for different amplification times are shown in Table 2.

TABLE 2

Density and amplification time

| Amplify | Dmax and Dmin Densities(×100) | | | | | |
|---|---|---|---|---|---|---|
| | Dmax | | | Dmin | | |
| times (sec) | R | G | B | R | G | B |
| 0 | 59 | 61 | 65 | 8.6 | 9.3 | 7.1 |
| 10 | 81 | 88 | 87 | 9.3 | 10.0 | 7.5 |
| 20 | 110 | 122 | 124 | 9.0 | 9.6 | 7.2 |
| 30 | 131 | 152 | 152 | 9.3 | 10.0 | 8.1 |
| 40 | 165 | 172 | 177 | 9.0 | 9.9 | 7.9 |

TABLE 2-continued

| Density and amplification time | | | | | | |
|---|---|---|---|---|---|---|
| | Dmax and Dmin Densities(×100) | | | | | |
| Amplify | Dmax | | | Dmin | | |
| times (sec) | R | G | B | R | G | B |
| 50 | 169 | 195 | 200 | 9.2 | 10.2 | 8.6 |
| 60 | 222 | 223 | 220 | 9.3 | 10.2 | 8.7 |
| 70 | 239 | 237 | 238 | 9.4 | 10.4 | 9.0 |
| 80 | 245 | 254 | 246 | 9.7 | 11.0 | 9.7 |
| 90 | 277 | 267 | 258 | 9.6 | 11.1 | 10.4 |
| 45(amp only) | 259 | 238 | 226 | 9.7 | 10.2 | 8.5 |

If the intermediate wash is omitted then there is almost no amplification because the sulfite in the strip reacts with peroxide and carried-over sulfite will eventually destroy all the peroxide in the amplifier bath.

It can be seen that any desired amplification can be obtained depending on the time in the amplifier bath. This could be monitored automatically and varied depending on the particular result. The last strip (processed in the amplifier for 45 seconds without any pre-treatment) has a higher density than a strip which has been through the whole process and then amplified for 45 seconds. This is probably because of impurities in the sulfite.

EXAMPLE 2

(Comparative Example)

Example 1 was repeated using alternative fixing solutions.

The process cycle was as follows:

| | |
|---|---|
| color developer | 30 sec (dark) |
| fix | 2 min (dark) |
| wash | 2 min (light) |
| amplify | variable (light) |
| wash | 2 min |
| dry | |

The developer composition was as in Table 1 and the amplifier was made by adding 2 ml/l of 30% hydrogen peroxide to this developer.

The fixing solution used was ammonium thiosulfate (40 g/l).

The results for various amplification times are shown in Table 3 below:

TABLE 3

| | Dmax and Dmin densities(×100) | | | | | |
|---|---|---|---|---|---|---|
| amplify | Dmax | | | Dmin | | |
| (sec) | R | G | B | R | G | B |
| 0 | 56 | 52 | 53 | 10 | 10 | 9 |
| 20 | 57 | 52 | 57 | 10 | 11 | 9 |
| 30 | 58 | 52 | 59 | 10 | 10 | 10 |
| 40 | 58 | 52 | 61 | 10 | 11 | 14 |
| 50 | 58 | 54 | 65 | 10 | 11 | 16 |
| 60 | 59 | 53 | 61 | 10 | 11 | 11 |
| 60(no fixer) | 260 | 252 | 248 | 22 | 20 | 22 |

The results show that the ammonium thiosulfate fixing solution completely poisons the silver formed in the developer stage such that no amplification is possible afterwards.

EXAMPLE 3

(Comparative Example)

The same procedure was followed as in Example 2 except that the ammonium thiosulfate fixing solution was replaced by an ammonium bromide fixer at 150 g/l.

The results for various amplification times are shown in Table 4 below:

TABLE 4

| | Dmax and Dmin densities(×100) | | | | | |
|---|---|---|---|---|---|---|
| amplify | Dmax | | | Dmin | | |
| (sec) | R | G | B | R | G | B |
| 0 | 56 | 52 | 53 | 10 | 10 | 9 |
| 20 | 73 | 67 | 76 | 12 | 12 | 8 |
| 30 | 73 | 69 | 83 | 12 | 12 | 8 |
| 40 | 70 | 67 | 76 | 11 | 12 | 8 |
| 50 | 88 | 84 | 99 | 12 | 12 | 8 |
| 60 | 80 | 81 | 95 | 12 | 12 | 9 |
| 60(no fixer) | 247 | 230 | 241 | 16 | 15 | 12 |

These results show that the ammonium bromide fixer almost completely poisons the silver formed in the developer stage such that only a very small amount of amplification occurs afterwards.

EXAMPLE 4

In order to overcome the peroxide loss occurring in Example 1, another type of fixing solution was employed having the composition:

| | |
|---|---|
| Diethylenetriaminepentaacetic acid pentasodium salt, 40% soln. | 50 ml/l |
| Diethanolamine (DEA) | 50 ml/l |

The process cycle was:

| | |
|---|---|
| color developer | 30 sec (dark) |
| fix | 2 minimum (dark) |
| wash | 2 minimum (light) |
| amplify | 45 sec (light) |
| wash | 2 min |
| dry | |

Two strips were processed, one with a wash between the fix and amplifier, and one without.

TABLE 5

| With and without intermediate wash | | | | | | |
|---|---|---|---|---|---|---|
| | Dmax and Dmin densities(×100) | | | | | |
| | Dmax | | | Dmin | | |
| | R | G | B | R | G | B |
| Wash | 278 | 264 | 248 | 10.2 | 11.9 | 13.5 |
| No wash | 280 | 260 | 249 | 10.2 | 11.4 | 12.4 |

There is no significant difference between the washed and unwashed strip and the amplifier solution still functioned after carry-over from the fixing solution. In addition, the Dmax is much higher than with the sulfite fixing solution for a similar amplification time. A range of amplification time is shown in Table 6.

TABLE 6

| amplify | Dmax and Dmin densities(×100) | | | | | |
|---|---|---|---|---|---|---|
| | Dmax | | | Dmin | | |
| (sec) | R | G | B | R | G | B |
| 10 | 122 | 126 | 114 | 9.5 | 10.6 | 9.8 |
| 15 | 165 | 153 | 143 | 9.2 | 10.2 | 10.1 |
| 20 | 186 | 172 | 168 | 9.6 | 10.6 | 10.5 |
| 25 | 217 | 194 | 183 | 9.6 | 10.7 | 10.4 |
| 30 | 225 | 215 | 204 | 9.7 | 10.8 | 11.4 |

As in Example 1 any desired amplification can be obtained.

EXAMPLE 5

In this example the fixing agents (50 ml/l AC8 and 50 ml/l DEA) were included in the first developer solution in order to perform the fixing stage during development. No fixer components were added to the amplifier which was the same as in Examples 1 and 2. The process cycle was as follows:

| | |
|---|---|
| Develop/fix | 1 to 3 min (dark) |
| Wash | 2 min (dark) |
| Amplify | 45 sec (light) |
| Wash | 2 min |
| Dry | |

The Dmax and Dmin densities obtained are shown in Table 7.

TABLE 7

| Dev/fix | | Fixing in the developer Densities (×100) | | | | | |
|---|---|---|---|---|---|---|---|
| | | Dmax | | | Dmin | | |
| (min) | Wash | R | G | B | R | G | B |
| 1.0 | yes | 226 | 215 | 233 | 10.5 | 12.5 | 23.6 |
| 2.0 | yes | 228 | 221 | 231 | 10.6 | 13.4 | 22.2 |
| 3.0 | yes | 212 | 224 | 235 | 10.3 | 13.0 | 23.7 |
| 2.0 | no | 232 | 227 | 250 | 10.6 | 13.5 | 30.5 |

Where the wash refers to that between the develop/fix and amplifier.

Clearly, fixing does occur in the developer but a high Dmin is obtained particularly in the blue and this is slightly worse if the wash is omitted.

The invention has been described in detail with particular reference to preferred embodiments thereof, but it will be understood that variations and modifications can be effected within the spirit and scope of the invention.

I claim:

1. A method of processing an imagewise exposed photographic silver halide color material comprising two or more silver halide layers sensitized to different regions of the visible spectrum having associated therewith appropriate dye image forming couplers, said method comprising during or after a development step that produces a silver image, fixing said material using a fixing solution comprising a fixing agent that does not poison the catalytic properties of the silver image to an extent that is more severe than a 30 g/l solution of sodium sulfite, and subsequently forming a dye image by redox amplification while monitoring the extent of image formation with visible light and making adjustments to the time of treatment or composition of the redox amplifying solution in order to obtain results of a predetermined quality.

2. The method of claim 1 wherein said redox amplification step is carried out using either a developer/amplifier solution containing a color developing agent and hydrogen peroxide or a compound that yields hydrogen peroxide, or separate developer and amplifier solutions.

3. The method of claim 1 wherein said fixing step is followed by a washing step.

4. The method of claim 1 wherein said fixing agent is a compound having at least one $N—[(CH_2)_n—A]_p$ moiety wherein A is —COOH or $—PO_3H_2$, n is 1 to 6 and p is 1 to 3, provided that said compound contains at least 2 A groups.

5. The method of claim 1 wherein said fixing agent is:

ethylenediaminetetraacetic acid (EDTA), propylenediaminetetraacetic acid, 2-hydroxy-1,3-propylenediaminetetraacetic acid, diethylenetriaminepentaacetic acid, nitrilotriacetic acid, ethylenediaminetetramethylene phosphonic acid, diethylenetriaminepentamethylene phosphonic acid, cyclohexylenediaminetetraacetic acid,

[(ethylenedioxy)diethylenedinitrilo]tetraacetic acid, or ethylenedinitrilo-N,N'-bis(2-hydroxy benzyl)N,N'-diacetic acid.

6. The method of claim 1 wherein said fixing solution contains a fix accelerator.

7. The method of claim 6 wherein said fixing accelerator is a primary, secondary, or tertiary alkylamine, an alkyl diamine, triamine, tetramine, pentamine or hexamine, a cyclic polyamine, an aryl amine, a mono, di, or tri-alkanolamine, a thioether, a thioamine, or morpholine.

8. The method of claim 1 wherein dye image formation is monitored by eye.

9. The method of claim 1 carried out in a processing machine by passing said material through a tank containing a processing solution that is recirculated through said tank at a rate of from 0.1 to 10 tank volumes per minute.

10. The method of claim 9 wherein dye image formation is monitored by means of a sensor located inside said processing machine that is programmed: to stop redox amplification when a predetermined set of conditions are observed, or to initiate solution replenishment.

11. The method of claim 10 wherein data obtained from said sensor is compared with data obtained from a printer used to imagewise expose said material before any changes are made.

12. The method of claim 9 wherein the ratio of tank volume to maximum area of photographic material accommodatable therein is less than 11 $dm^3/m^2$.

* * * * *

UNITED STATES PATENT AND TRADEMARK OFFICE

CERTIFICATE OF CORRECTION

PATENT NO. : 5,686,229

DATED : November 11, 1997

INVENTOR(S) : Peter J. Twist

It is certified that error appears in the above-identified patent and that said Letters Patent is hereby corrected as shown below:

Title page, item [30] should read--Foreign Application Priority Data
Sep. 15, 1995 [GB] United Kingdom..9518912.2

Signed and Sealed this

Twenty-second Day of September, 1998

*Attest:*

Bruce Lehman

BRUCE LEHMAN

*Attesting Officer*

*Commissioner of Patents and Trademarks*